United States Patent [19]

Svendsen

[11] 4,254,298

[45] Mar. 3, 1981

[54] DIRECT CURRENT SMELTING FURNACE

[75] Inventor: Eivind C. K. Svendsen, Oesteraas, Norway

[73] Assignee: Elkem-Spigerverket A/S, Norway

[21] Appl. No.: 959,317

[22] Filed: Nov. 9, 1978

Related U.S. Application Data

[63] Continuation-in-part of Ser. No. 945,415, Sep. 25, 1978.

[51] Int. Cl.[3] ..... H05B 7/144

[52] U.S. Cl. ..... 13/12; 13/9 ES; 13/24

[58] Field of Search ..... 13/9, 9 ES, 11, 12, 13/24, 23

[56] References Cited

U.S. PATENT DOCUMENTS

| | | | |
|---|---|---|---|
| Re. 12,658 | 6/1907 | Heroult | 13/9 ES X |
| 2,927,143 | 3/1960 | Jensen | 13/12 |
| 3,949,151 | 4/1976 | Kerton | 13/12 |
| 4,110,547 | 8/1978 | Peev | 13/11 |

*Primary Examiner*—Roy N. Envall, Jr.

*Attorney, Agent, or Firm*—Eyre, Mann, Lucas & Just

[57] ABSTRACT

A direct current smelting furnace is disclosed. The anode and cathode are series connected electrodes, both of which are immersed in the furnace charge. A plurality of pairs of electrodes is preferably employed.

1 Claim, 1 Drawing Figure

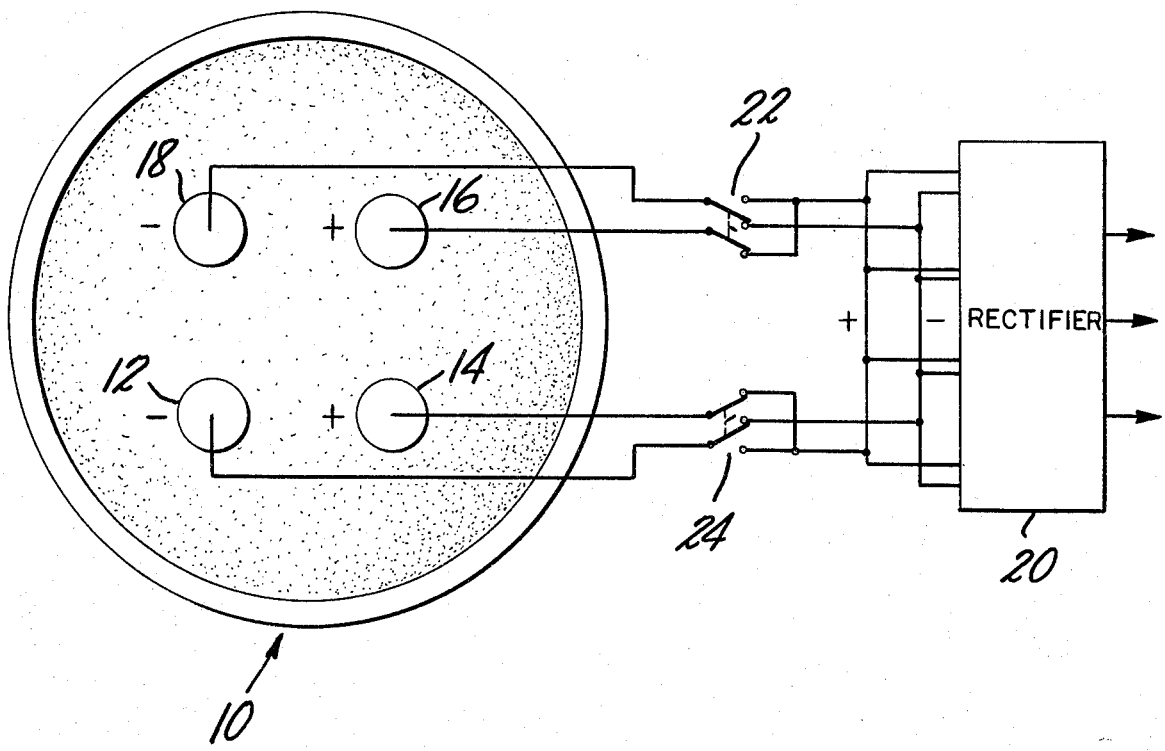
22
18
16
12
14
RECTIFIER
24
20
10

DIRECT CURRENT SMELTING FURNACE

This application is a continuation in part of U.S. application, Ser. No. 945,415, filed Sept. 25, 1978.

The present invention relates to electric smelting furnaces. More particularly, it relates to direct current electric smelting furnaces.

Direct current smelting furnaces have been known for a large number of years. These comprise a single top electrode serving as the anode and the bottom of the furnace pot is connected to act as the cathode. While this type of furnace was employed for a great number of years, it has largely fallen into disuse with the advent of alternating current 3-phase generators. These generators resulted in substantially improved power transmission and have resulted in the 3-phase alternating current smelting furnace being virtually the only one in use today.

There have recently been developed dry-type rectifiers for converting transmitted alternating current to direct current. With these improved rectifiers, it is possible to take advantage of the improved transmission properties of alternating current while still being able to use direct current at the furnace site. With these new dry-type rectifiers, it is possible to convert a standard three electrode 3-phase alternating current smelting furnace to a direct current furnace by simply connecting the three electrodes to be direct current anodes while maintaining the furnace bottom as the cathode. Unfortunately, dry-type rectifiers are comparatively large and expensive equipment and it is quite doubtful that large direct current furnaces of the type just described could compete with 3-phase alternating current furnaces. While the concept is certainly possible, the practicalities do not appear to be present.

The inventor has now discovered an electrical arrangement of the electrodes which makes it possible to increase the voltage and the furnace load of a direct current furnace without requiring a corresponding increase in the expense of electrical equipment. The economics of this system are such that a direct current smelting furnace can be made which can compete with 3-phase alternating current furnaces and, in addition, will have substantial additional advantages including especially load capacity. This is primarily because of the lack of the "skin effect" property in using direct current, an undesirable property which is present in alternating current smelting furnaces.

In accordance with the present invention, the bottom of the furnace is no longer used as an electrode. Rather, there is employed an even number of electrodes, each pair of which is connected in series. With this new and useful arrangement, there is obtained an increase in load capacity of the furnace as compared to existing direct current furnaces and as compared to existing alternating current furnaces.

These and other aspects of the present invention may be more fully understood with respect to the drawings wherein:

The FIGURE is a top view of a typical furnace according to the present invention.

The art of electric smelting furnaces is quite well developed and the structure of electric smelting furnaces is quite well known in the art. In this connection reference is made to U.S. Pat. Nos. 3,895,175 and 4,001,488 for representative showings of electric smelting furnaces. Since the general configuration of electric smelting furnaces is so well known, the figure of the present invention is limited to a somewhat schematic top view which shows the novel construction of a smelting furnace according to the present invention.

As there shown, there is a circular furnace pot 10 having a plurality of electrodes 12, 14, 16, 18 positioned therein. It has been found that an arrangement of four electrodes in a circular furnace pot gives quite excellent results in accordance with the present invention. The electrodes are electrically connected to rectifier 20 by means of a series of bus bars and flexibles as shown. Electrodes 12 and 14 form an electrode pair with electrode 14 being positive and electrode 12 being negative in the FIGURE. Similarly, electrodes 16 and 18 form an electrode pair with 16 being the positive and 18 being the negative. This arrangement, by itself, will work. However, it has been found that substantial advantage can be obtained if the polarity of the electrode pairs can be reversed. This advantage is in terms of both heat buildup and evenness of electrode wear.

For accomplishing the polarity switching, there is preferably employed a switching mechanism 22, 24 between the rectifier 20 and the electrode pairs. It is, of course, possible to activate switches 22 and 24 simultaneously so that there will be a simultaneous reversal of polarity in the two electrode pairs. However, it has been discovered that even greater advantage can be obtained if the switches are controlled so that four different electrical arrangements are obtained in the furnace pot. Starting from the embodiment shown, this can suitably be obtained by, after a first predetermined period of time, flopping switch 22 to reverse the polarity of electrodes 16 and 18, after a second predetermined period of time flopping switch 24 to reverse the polarity of electrodes 14 and 12, after a third predetermined period of time flopping switch 22 to return electrodes 16 and 18 to the polarity shown in the FIGURE and, finally, after a fourth predetermined period of time, flopping switch 24 to its original position to reobtain the polarity shown in the FIGURE. The electrodes have thus been arranged in four different electrical configurations and it has been found that this is the most desirable arrangement.

It will be appreciated that, in operation, the electrodes do not know the other electrodes with which they are paired. Therefore, current will flow through the charge from all electrodes operating as anodes to all electrodes operating as cathodes. Naturally, the chief flow of current will be through the smelting bath (not shown) at the bottom of the furnace pot.

As mentioned before, the arrangement of the present invention has substantial advantage over known direct current and alternating current furnace arrangement. With respect first to known direct current furnaces, which are all of the single electrode type, the use of two electrodes in the top of the furnace in accordance with the present invention enables one, using the same rectifier as in the single electrode furnace, to obtain double the voltage with the same amount of current. Furthermore, since there are two pairs of top electrodes, each pair of which is connected in series, the same electrode dimension will result in a doubling of the current as well as a doubling of the voltage so that the furnace load will be four times as large as compared to a furnace with a single top electrode and the bottom of the furnace pot acting as the other electrode.

When comparing the present invention to a standard 3-phase alternating current furnace, the load of the furnace of the present invention will be 4/3 the load of the alternating current furnace if the electrode dimension is the same. This alone is an advantage. However, the advantage becomes even greater as larger electrodes are employed since electrodes employing alternating current are subject to the undesirable "skin effect" property and this property becomes more and more of a problem as electrode diameter increases. Because of this, electrodes in a direct current furnace can be fed with considerably more current than corresponding electrodes in an alternating current furnace. In addition to the "skin effect" problem, alternating current furnaces of the dimensions customarily used today also suffer losses because of eddy currents and hysteresis. Losses of this nature are not encountered with direct current. Because of the savings which direct current has over alternating current in terms of the losses through "skin effect", eddy currents and hysteresis, the additional expense of the electrical equipment necessary for a direct current furnace is soon recovered, after which the savings represent profit.

It has been found that even greater efficiency can be obtained by coupling two or more furnaces in series so that a larger number of electrodes is connected in series. In this way, the best utilization of the rectifier is obtained.

It will be understood that the claims are intended to cover all changes and modifications of the preferred embodiments of the invention, herein chosen for the purpose of illustration, which do not constitute departures from the spirit and scope of the invention.

What is claimed is:

1. In an electric smelting furnace comprising a furnace pot adapted to contain a charge to be smelted, the improvement comprising:

(a) at least two pairs of electrodes arranged in said furnace from the top thereof;

(b) a rectifier for supplying direct electric current to said electrodes;

(c) each pair of electrodes being connected in series with the rectifier output wherein one electrode within each pair acts as a cathode and the other acts as an anode; and (d) switching means, disposed between each said pair of electrodes and said rectifier output, capable of reversing the polarity of each said pair of electrodes, said switching means also being capable of switching the polarity of each said pair of electrodes independently of the switching of at least one other pair of electrodes.

* * * * *